US005537792A

United States Patent [19]

Moliere

[11] Patent Number: 5,537,792

[45] Date of Patent: Jul. 23, 1996

[54] DECORATIVE WALL COVERING

[75] Inventor: Alfred Moliere, Miami, Fla.

[73] Assignee: Nailite International, Miami, Fla.

[21] Appl. No.: 409,856

[22] Filed: Mar. 23, 1995

[51] Int. Cl.[6] ..... E04D 1/26

[52] U.S. Cl. ..... 52/531; 52/521; 52/533; 52/535; 52/536; 52/539; 52/546; 52/555

[58] Field of Search ..... 52/520, 521, 531, 52/533, 535, 536, 539, 546, 553, 555, 314, 98

[56] References Cited

U.S. PATENT DOCUMENTS

| | | |
|---|---|---|
| 4,522,002 | 6/1985 | Davis et al. . |
| 4,680,911 | 7/1987 | Davis et al. . |
| 5,072,562 | 12/1991 | Crick et al. . |
| 5,076,037 | 12/1991 | Crick et al. . |
| 5,249,402 | 10/1993 | Crick et al. . |
| 5,347,784 | 9/1994 | Crick et al. . |

*Primary Examiner*—Wynn E. Wood
*Assistant Examiner*—Yvonne Horton-Richardson
*Attorney, Agent, or Firm*—Leydig, Voit & Mayer, Ltd.

[57] ABSTRACT

A wall covering comprising a plurality of plastic molded panels each having a relatively thin body portion formed with rows of simulated building elements. The panels are mounted on a support surface in a plurality of horizontal courses with a side marginal edge region of one panel overlapping and sealingly engaging an underlying side marginal edge region of the adjacent panel and a lower marginal region of a panel in one course overlying an upper marginal region of a panel in a lower course. Each panel is provided with frangible locating means for positively locating an interlock lip of the overlying panel in predetermined engaged relation with interlock flanges of an underlying panel. The interlock flanges of the panels are provided with reinforcement ribs to prevent breakage when the panels are exposed to weather extremes and undergo thermal expansion or contraction. Finally, each panel is provided with side interlock means which enhance the panel's resistance to buckling during installation and use.

20 Claims, 4 Drawing Sheets

DECORATIVE WALL COVERING

FIELD OF THE INVENTION

The present invention relates generally to roof and wall coverings which are primarily intended for outdoor usage, and more particularly, to roof and wall coverings comprised of relatively large panels which each are molded or otherwise formed with decorative patterns characteristic of conventional roofing and siding materials, such as shake shingles, tile, brick or the like.

BACKGROUND OF THE INVENTION

Various synthetic roof and wall coverings, such as those formed of elongated thermoplastic panels that are nailed to a wall or roof support surface in horizontal courses or rows in partially overlapping relation to each other so as to provide a substantially water resistant, protective layer over the support surface, are known today. Such panels, which usually are identically molded, are commonly formed with a plurality of rows of simulated building elements, such as shake shingles. Because the panels are identically molded, a panel-to-panel identity can be easily noticed if the panels are not carefully installed. Leakage problems between adjoining panels can also occur under these circumstances.

To facilitate installation, such panels typically are nailed to the wall or support surface along an upper horizontal nailing flange with the lower marginal edge region overlapping the panel in the course immediately below and with one side marginal edge region overlapping the laterally spaced adjacent panel. While various means have been proposed for interlocking the overlapping portions of adjacent panels to provide a water seal therebetween and to minimize the noticeability of the junctions between panels, such interlocks often have been cumbersome to engage during installation and frequently have been ineffective in establishing and maintaining sealed engagements between panels, particularly when the panels are mounted on irregular surfaces or are exposed to extreme weather conditions.

More specifically, since such panels are relatively large in size, it is necessary that they be firmly positioned upon the wall or roof surface upon which they are mounted and that they be reliably interlocked along both upper and side marginal edge regions in order to prevent the adjoining edges of the panels from being noticeable and in order to provide a reliable seal between such edges. Because the panels are exposed to relatively wide temperature variations, however, they can experience significant expansion and contraction after installation. Such thermal expansion and contraction can disrupt seals between the panels and detract from the finished appearance of the wall covering if proper accommodation is not made.

While it is desirable to interlock both the horizontal and vertical sides of such panels with adjacent panels, heretofore it has been difficult to provide for reliable interlocks while still permitting adequate expansion and contraction of the installed panels. For example, with respect to the horizontal sides, proposals have been made for locating the lower marginal edge region of an overlapping panel in predetermined relation to the underlying interlock at a precise location so as to permit both expansion and contraction of the panels. However, this heretofore has been a relatively tedious installation step. Proposals to assist the installer of the panels in locating the overlapping marginal edge region at the precise desired location also have not been entirely reliable, or often are ignored by hasty installers, or are cumbersome.

Interlocking the side marginal edge regions of such panels also have presented problems. Since the panels are relatively long, engaging or locking the peripheral edges of the panels can create undesirable bowing of the panels during installation and during use when the panels undergo thermal expansion or contraction. In addition to bowing, if proper accommodations are not made, expansion or contraction can also fracture the flanges which interlock the panels together. Moreover, when one or more of these flanges are so fractured, the remaining flanges often are insufficient to adequately retain or support the panel in the mounted position, and, in the long term, dis-orientation of the panel, leakage, and the subsequent need for repair and replacement can result.

OBJECTS AND SUMMARY OF THE INVENTION

It is an object of the present invention to provide a wall or roof panel which permits positive interlocking engagement between overlapping upper and lower marginal edge regions of adjacent panels, while enabling the panel to be reliably and easily installed so as to accommodate thermal expansion and contraction.

Another object is to provide a synthetic panel as characterized above which precisely locates interlocking flanges of the overlapping upper and marginal edge regions of a panel to a precise location, and which cannot be bypassed or ignored by an installer of the panel.

A further object is to provide a wall or roof panel of the above kind which includes reinforced interlock flanges which resist breakage in the event of excessive thermal contraction or the like and which, in the event one or more such flanges do suffer breakage, have sufficient strength to maintain the panel in its properly installed position.

Still another object is to provide a wall or roof panel of the foregoing type with improved side interlock means that resist bowing of the panel both during installation and during use when the panels undergo thermal expansion or contraction.

Other objects and advantages of the invention will become apparent upon reading the following detailed description and upon reference to the drawings, in which:

Figure 1:
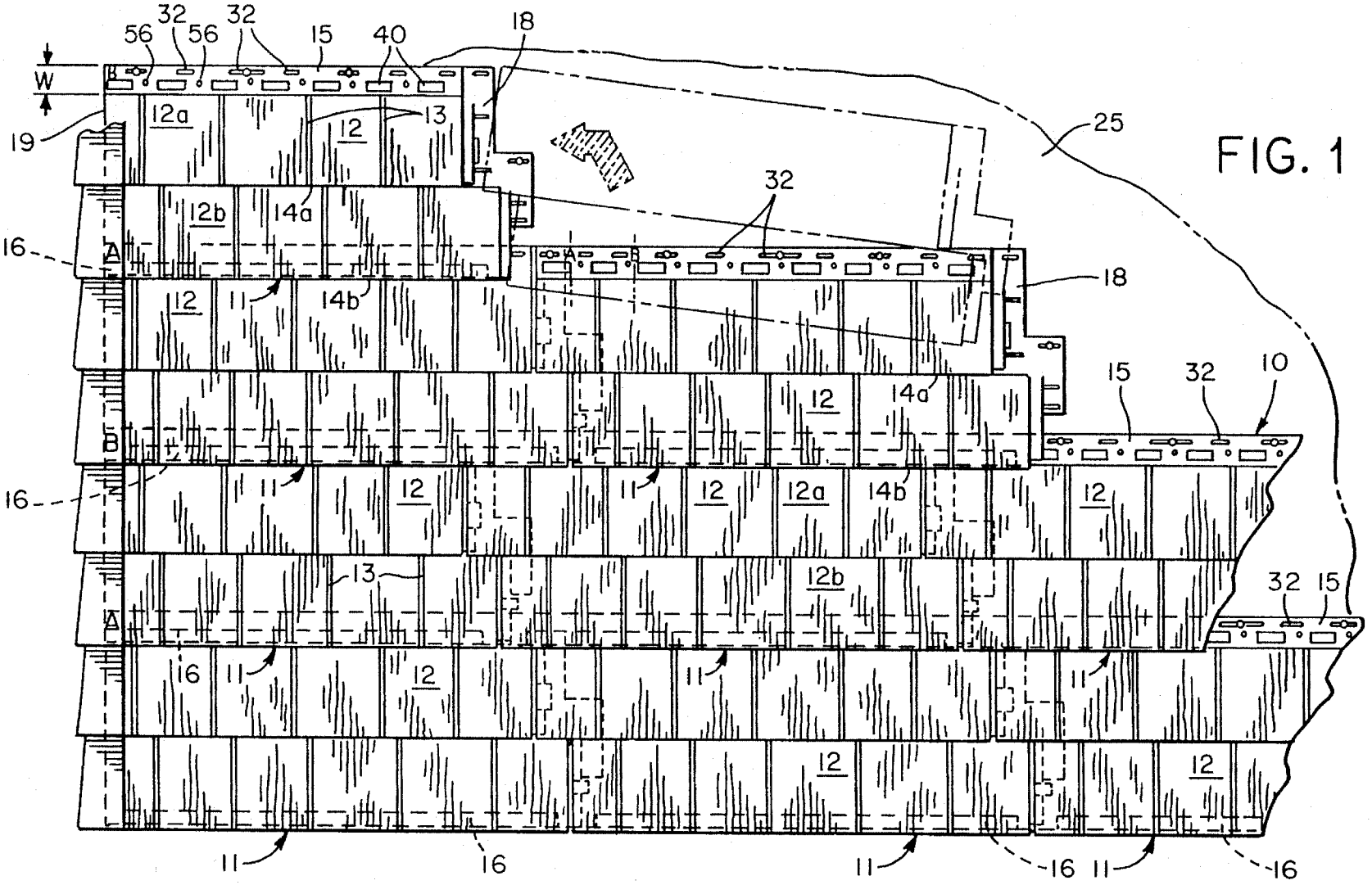
FIG. 1 is a plan view of a wall covering comprising panels constructed in accordance with the teachings of the instant invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF A PREFERRED EMBODIMENT

Referring now more particularly to FIG. 1 of the drawings, there is shown an illustrative wall covering 10 comprising a plurality of panels 11 each constructed in accordance with the present invention. The general type of panels 11 employed in the instant invention are described in commonly assigned U.S. Pat. No. 5,347,784, which is incorporated herein by reference. As shown in FIG. 1, the panels 11 each are formed with simulated building elements. In this instance, the panels 11 are formed with simulated cedar shake 12 of irregular width which are disposed in a plurality of parallel rows 12*a*, 12*b* with adjacent shake 12 in each row being separated by a small gap 13. The illustrated simulated shake pattern is of a type known in the industry as "perfection" shake, wherein the lower edges 14*a*, 14*b* of the rows 12*a*, 12*b* are in a substantially straight line, and except for their width, the individual shake elements are substantially similar in appearance. It will be understood that the panels 11 could be formed with other forms of simulated shake shingles, or other types of building materials, such as tile, brick and the like.

Each panel 11 has an upper horizontal marginal edge region 15 having a substantially uniform width "w" extending across the top of the panel immediately above the top row 12*a* of shake 12, a lower marginal edge region 16 which defines a lower peripheral edge of the panel, a side marginal edge region 18 located to the right-hand side of the last simulated shake 12 in each row 12*a*, 12*b*, and a marginal edge region 19 on the opposite side of the panel 11 which defines a left-side peripheral edge immediately adjacent the first simulated shake of each row 12*a*, 12*b*. The panels 11 are mounted on a support surface 25, which may be a wall or roof of a house or other building structure, in horizontal courses with the right-side marginal edge region 18 in underlying relation to the left-side marginal edge region 19 of the panel immediately to the right thereof and with the lower marginal edge region 16 of the panels in each course overlying the upper marginal edge region 15 of the panel in the course immediately below.

To enable mounting of the panels 11 in side-by-side relation with the junctures between adjacent panels less noticeable to the eye, the rows 12*a*, 12*b* of shake 12 of each panel 11 extend in offset relation to each other so as to define stepped left and right-hand sides of the panel. In the illustrated embodiment, the second row 12*b* of shake extends farther to the right than the first row 12*a* a distance corresponding to about one-quarter to one-half the width of one shake 12.

The panels 11 preferably are mounted beginning with the left-hand panel of the lowermost course to be installed on the wall or roof, as is known in the art. The first panel in each course typically is cut at a different location along a left-hand side thereof in order that the simulated shake 12 of each course are offset with respect to the simulated shake of the panel 11 in the course below so as to enhance the natural appearance of the wall covering. The panels 11 in this instance each have two predetermined cutting lines A, B (FIG. 1) along which the panels 11 alternatively may be cut to start alternate courses as disclosed in U.S. Pat. No. 5,076,037, assigned to the same assignee as the present application and incorporated herein by reference.

Figure 3:
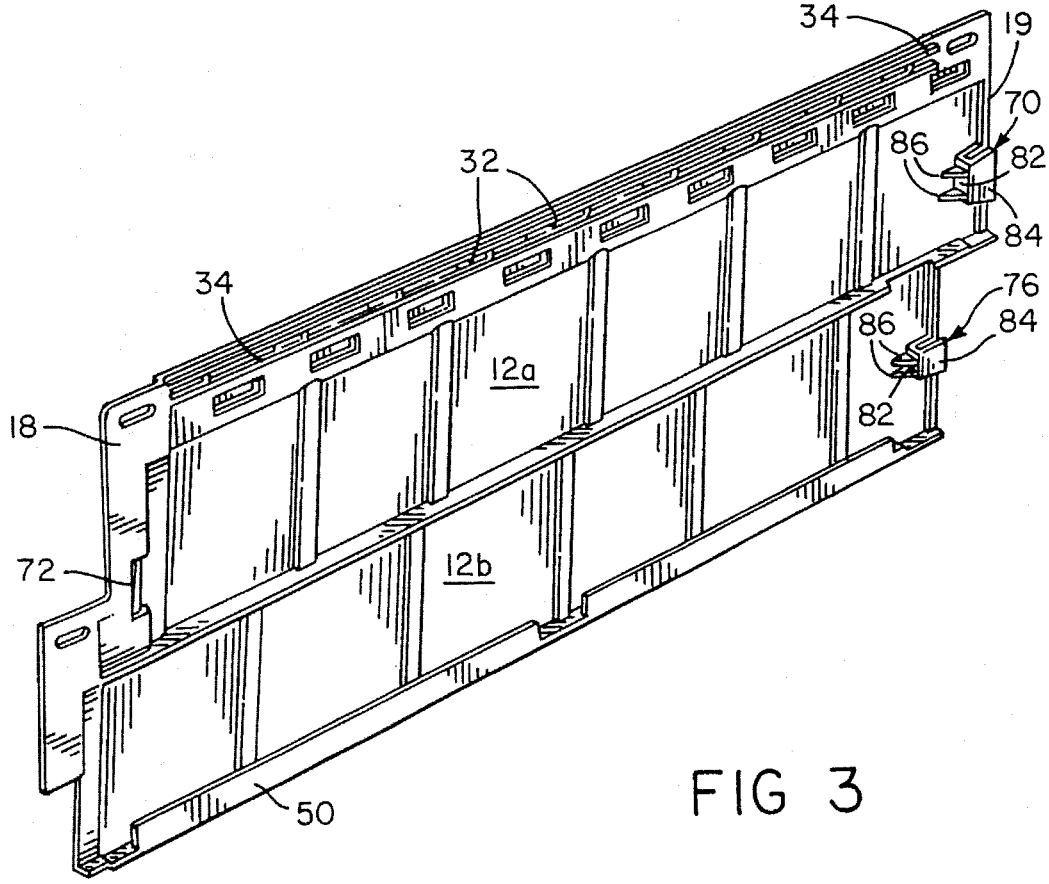
FIG. 3 is a left, rear perspective view of the panel shown in FIG. 2.

For securing the panels 11 to the support surface 25, the upper marginal edge region 15 of each panel 11 is formed with a row of elongated laterally spaced nailing apertures 32. In order to provide firm support for the panel 11 on the wall during nailing and for establishing a seal between the rear side of the panel 11 and the support surface 25, the upper marginal edge region 15 is formed with a pair of rearwardly extending horizontal sealing flanges 34 which extend substantially the length of the upper marginal edge region 15 on top and bottom sides of the nailing apertures 32 (FIG. 3). Once the upper marginal edge region 15 is nailed to the support surface, the horizontal sealing flanges 34 are maintained firmly against the support surface 25 and cannot be lifted from the support surface 25 even during severe weather conditions. However, it will be appreciated that, in the preferred embodiment, nails are not driven into the support structure 25 as firmly as possible. Thus, although the nailing is performed to hold the panels snugly against the support structure, the nails are preferably applied such that some shifting of the panels can occur during thermal expansion and contraction.

Figure 4:
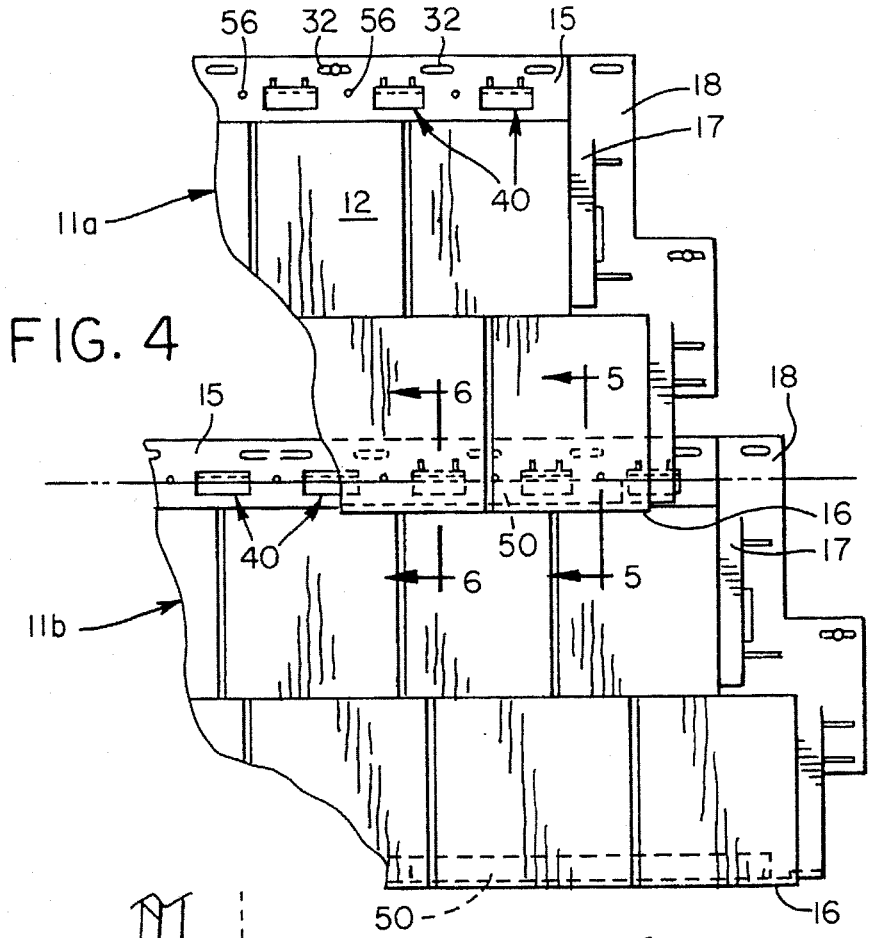
FIG. 4 is an enlarged fragmentary view of the face side of two panels showing the engagement of their lower and upper marginal edges.

In the following description, when discussing the interaction of panels disposed in vertically displaced courses, the upper panel will be designated with the reference "11*a*" and the lower panel will be designated with the reference "11*b*" (FIG. 4). This convention is employed in order to clarify the relative positions of the subject panels. It will be understood, of course, that despite this nomenclature, the individual panels are substantially identical, and the distinguishing nomenclature is used only to designate positional, not structural, differences.

In order to positively interlock the overlapping lower marginal edge region 16 of an upper or overlying panel 11*a* with the upper marginal edge region 15 of an underlying or lower panel 11*b*, each panel 11 is formed with a plurality of laterally spaced forwardly and downwardly directed interlock flanges 40 disposed on the upper marginal edge region 15 between the nailing apertures 32 and the first row of building elements 12*a*. The interlock flanges 40 in this instance have an upper base portion 42 extending outwardly from the upper marginal edge region 15 and a relatively flat locking portion 44 extending downwardly from the upper base portion 42. The relatively flat locking portion 42 is disposed a distance from the forward surface 46 of the upper marginal edge region 15 such that the locking flange 40 and the face of the upper marginal edge region 15 form a slot. In the preferred embodiment, this distance is on the order of one-eighth inch and the above-noted width "w" of the upper marginal edge 15 is on the order of 2 inches. However, those skilled in the art will readily appreciate that other distances and spacings might likewise be appropriate.

The interlock flanges 40 are molded such that a portion of the upper marginal edge region 15 directly below the retention flange is open as shown in FIG. 3. Consequently, the slot defined by the interlock flanges 40 and the upper marginal edge region 15 includes an open back.

Figure 6:
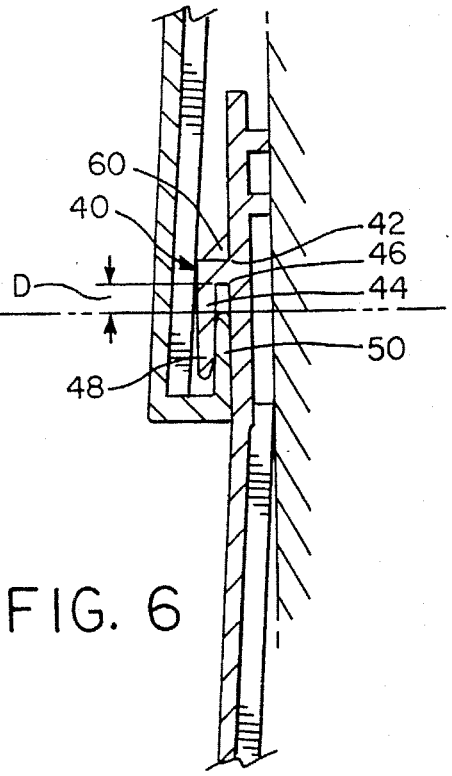
FIG. 6 is an enlarged fragmentary sectional view taken along lines 6—6 in FIG. 4.

In order to interlock with a panel 11*b* in a lower course, the lower marginal edge region 16 of the panel 11 is formed with a flange or interlock lip 50, running substantially the length of the panel 11 and having a thickness corresponding substantially to the distance between the locking portion 44 of the interlock flange 40 and the surface 46 of the upper marginal edge region 15. This interlock lip 50 can thus be positioned under the interlock flanges 40 disposed on the upper marginal region 15 of a lower panel 11*b*, as depicted in FIGS. 4 and 6. To facilitate installation of the lower marginal edge region lip 50 within the narrow slot formed between the interlock flanges 40 and the face of the panel 11*b*, the inner face of each interlock flange 40 is formed with a chamfered or beveled end 48 which guides the interlock lip 50 of the overlapping panel into the slot.

In order to accommodate for thermal expansion and contraction in the vertical direction of the panels 11, and hence, relative movement between the interlocking flanges 40, 50 of the upper and lower marginal edge regions 15, 16, it is desirable to mount the panels 11*a*, 11*b* with the uppermost portion of the interlock lip 50 of the overlying lower marginal edge region 16 separated a distance "D" from the upper base portion 42 of the interlock flange 40 as shown in FIG. 6. This distance "D" is preferably chosen such that the interlock lip 50 of the upper panel 11*a* may experience relative movement without causing the interlocking flanges 40, 50 to disengage or break. In the preferred embodiment, this distance is on the order of one-eighth inch.

Figure 2:
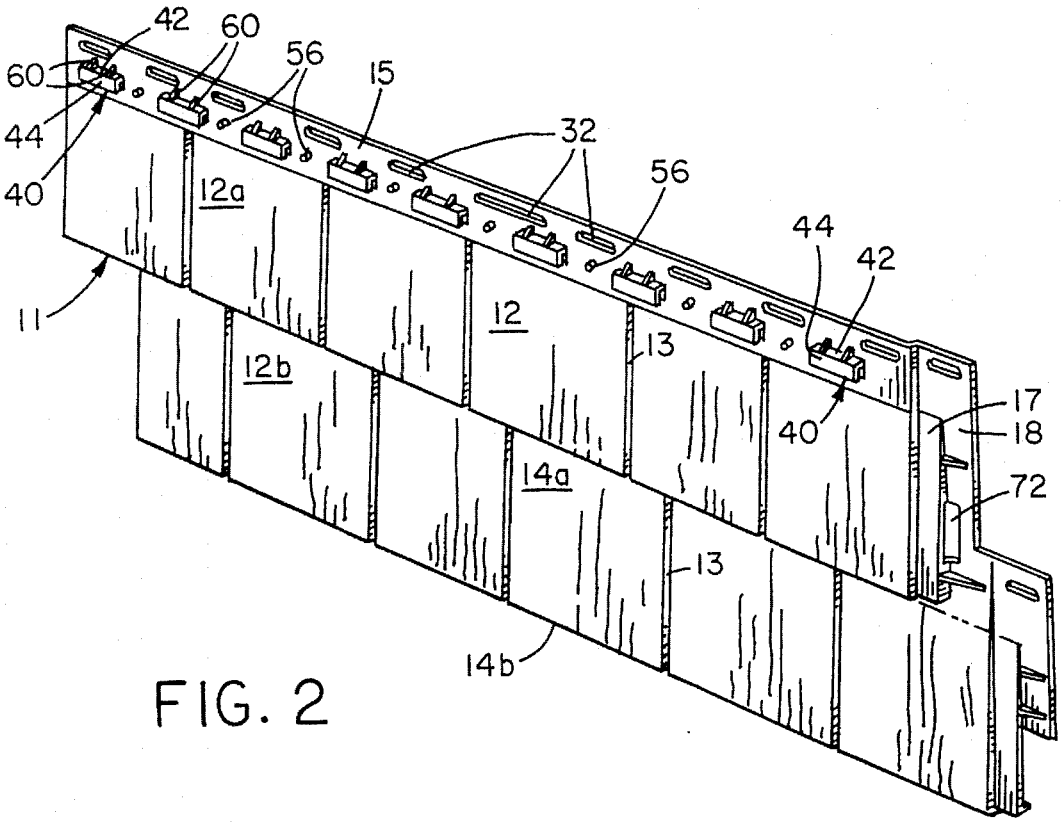
FIG. 2 is a right, front perspective view of a panel constructed in accordance with the teachings of the instant invention.
Figure 5:
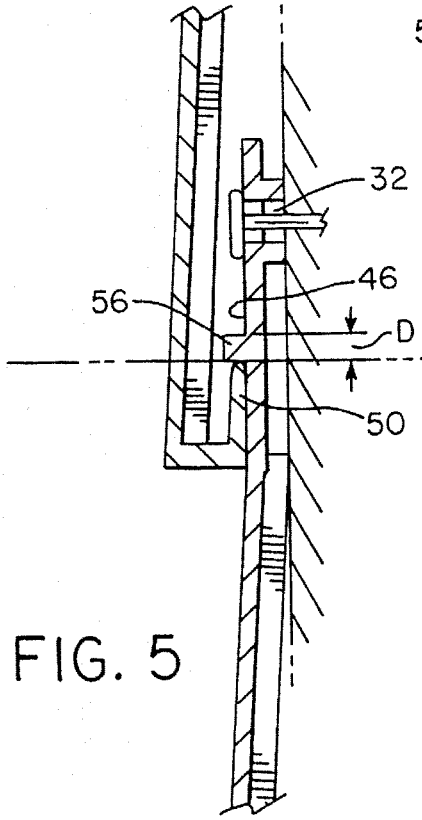
FIG. 5 is an enlarged fragmentary sectional view taken along lines 5—5 in FIG. 4.

In accordance with an important aspect of the invention, forwardly projecting, frangible locating means are provided on the upper marginal edge region 15 of each panel 11 for positively locating the interlock lip 50 of the upper panel 11*a* in predetermined engaged relation to the interlock flanges 40 of the lower panel 11*b*. The frangible locating means in the illustrated embodiment are a plurality of laterally spaced lugs or pins 56 which project a relatively small distance from the surface of the upper marginal edge 15. The locating lugs 56 in this instance are cylindrically shaped, have a diameter corresponding approximately to the distance "D" between the upper base portion 42 of the interlock flanges 40 and the uppermost portion of the interlock lip 50 as shown in FIG. 5 (i.e., about one-eighth inch), and have a height corresponding approximately to the distance between the interlock flanges 40 and the forward face 46 of the upper marginal edge region 15 (i.e., about one-eighth inch). The locating lugs 56 in this case are disposed at an intermediate In accordance with another aspect of the invention, the interlock flanges 40 are reinforced with ribs 60 in order to insure that in the case of extreme contraction the interlock flanges 40 are not broken by the interlock lip 50. As shown in FIGS. 2 and 6, these reinforcement ribs 60 are positioned adjacent the upper base portions 42 of the interlock flanges 40. The ribs 60 are integrally formed with the interlock flanges 40 and will resist flange breakage if the interlock lip 50 shears the locating lugs 56 and continues upwards to apply a force to the upper base portions 42 of the interlock flanges. In the unlikely event that despite the reinforcement ribs 60 one or more of the interlocking flanges 40 is broken by the interlock lip 50, the reinforcement ribs 60 will insure the remaining interlock flanges 40 are sufficiently strong to retain the panel in position.

In order to insure that the locating lugs 56 are sufficiently frangible to give way when subjected to the shearing forces attributable to contraction but sufficiently strong to withstand the forces they encounter during installation, the panels 11 are preferably molded from natural polypropylene which is approximately 20–40% loaded with calcium carbonate; with 40% loading currently being most preferable. The calcium carbonate loading insures that the locating lugs 56 are suitably frangible. The use of the natural polypropylene insures that the panels 11 are economically manufacturable, tough, attractive, and weather resistant. However, it will be appreciated by those skilled in the art that other materials and other compositions could be employed without departing from the scope or the spirit of the instant invention.

Figure 7:
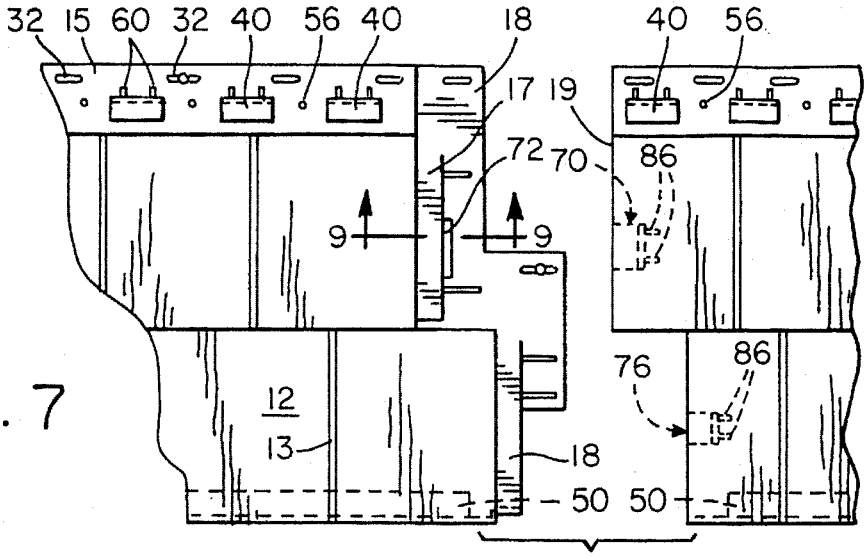
FIG. 7 is an enlarged fragmentary view of the face side of two adjacent panels shown in separated relation to each other.

In carrying out a further aspect of the invention, the panels 11 are provided with side interlock means intermediate the end of the underlying panel which increases resistance of the panels 11 to buckling during installation and during use. To this end, the side interlock means comprise a first projecting flange 70 positioned on the underside of the left side peripheral edge 19 of the panels 11 which matingly engages an aperture 72 defined in the side of an elevated portion 17 of the right hand side marginal edge region 18 of an adjacent panel 11 defined by one of the building elements, as shown in FIGS. 2 and 7. In this instance, the aperture 72 is disposed inboard of the staggered, outer perimeter of the panel 11 by about three and one-half inches at its furthest point and one inch at its closest point. The inboard positioning insures that adjacent panels 11 interlock at an intermediate location rather than at the perimeter edges of the panels 11, thereby providing stability and improving the buckling resistance of the panels 11 during installation and when subjected to thermal expansion and contraction.

Figure 10:
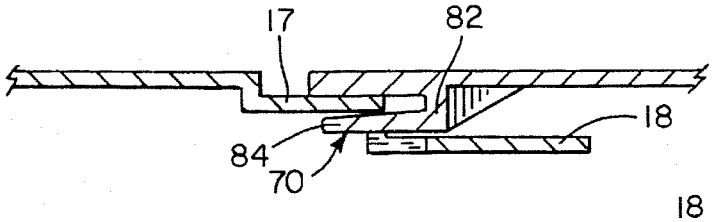
FIG. 10 is an enlarged, fragmentary sectional view taken along lines 10—10 in FIG. 8; and, FIG. 11 is an enlarged, fragmentary sectional view taken along lines 11—11 in FIG. 8.

In order to permit relative movement between overlapping side marginal edge regions of adjacent panels 11 during thermal expansion and contraction, the first projecting flange 70 includes a base portion 82 and a relatively flat locking portion 84 which define an open-ended slot or recess, as shown in FIGS. 3 and 10. The open-ended slot or recess insures that adjacent panels do not "hook" one another, but instead interlock in an open-ended manner which permits expansion and contraction without buckling.

Figure 8:
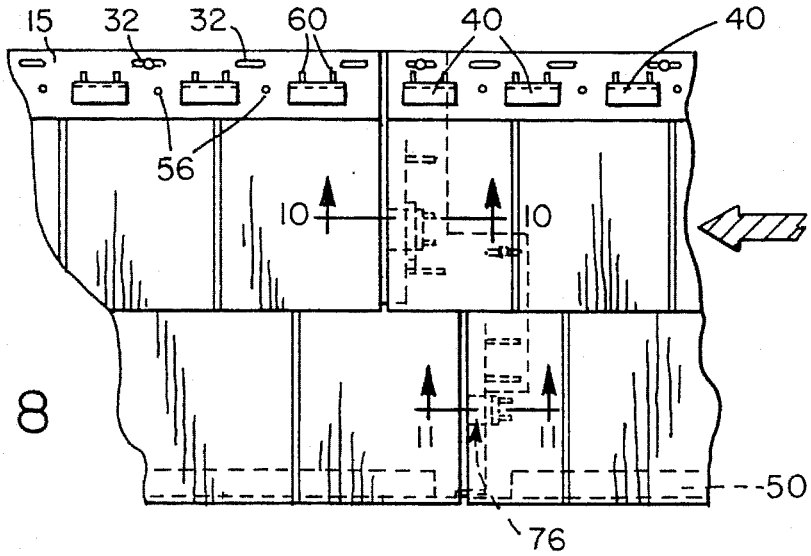
FIG. 8 is a view similar to FIG. 7 but showing the adjacent panels interlocked.
Figure 9:
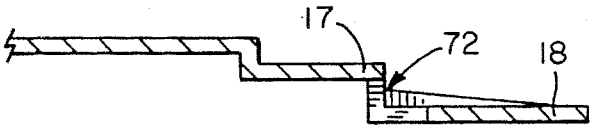
FIG. 9 is an enlarged, fragmentary sectional view taken along lines 9—9 in FIG. 7.
Figure 11:
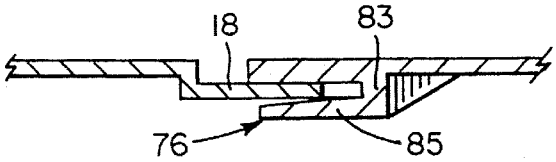

In order to provide further stability to the interlock between adjacent panels 11, each panel is further provided with a second projecting flange 76 disposed on the rearward side of the left-side peripheral edge 19 in the second row 12*a* of building elements. As shown in FIGS. 8 and 11, this second projecting flange 76 engages the right side peripheral edge 18 of an adjacent panel 11 and provides additional stability to the wall covering 10. In order to facilitate relative movement between adjacent panels 11, the second projecting flanges 76, like the first projecting flanges 70, include a base portion 83 and a relatively flat locking portion 85 which define an open-ended slot or recess. Thus, adjacent panels in a course can expand and contract in a horizontal direction without interference from the second projecting flanges 76.

The first and second projecting flanges 70, 76 are dimensioned such that they remain in engagement with the periphery of the adjacent panel even under extreme contraction. To this end, in the preferred embodiment, the open-ended slots or recesses of the first and second projecting flanges 70, 76 have a depth of approximately five-eights inches. However, it will be appreciated that other shapes and sizes of flanges can be employed without departing from the scope or the spirit of the instant invention. In order to increase the strength of the first and second projecting flanges 70, 76, and to prevent breakage from occurring during extreme expansion and contraction, the first and second projecting flanges 70, 76 are both provided with reinforcement ribs 86 as shown in FIG. 7. These reinforcement ribs 86 are integrally formed with the first and second projecting flanges 70, 76 and operate in substantially the same manner as the ribs 56 of the interlock flanges 40.

From the foregoing, it can be seen that the wall covering of the instant invention is adapted to permit positive interlocking engagement between overlapping panels while enabling the panels to be reliably and easily installed so as to accommodate thermal expansion and contraction. More specifically, it can be seen that the wall covering of the instant invention provides a panel which is adapted to precisely locate interlocking flanges of the overlapping upper and marginal edge regions of a panel to a precise location, and which cannot be bypassed or ignored by an installer of the panel. In addition, the invention provides a wall or roof panel with reinforced interlock flanges to resist breakage in the event of excessive thermal contraction and with improved side interlock means to resist bowing of the panel both during installation and use.

What is claimed is:

1. A wall covering for mounting on a support surface comprising:

a plurality of panels each having a body portion formed with simulated building elements; said panels each having upper and lower marginal edge regions;

said panels being mountable on said support surface in a plurality of horizontal courses with at least one of said panels in a first horizontal course having an upper marginal edge region underlying a lower marginal edge region of at least one of said panels in a second horizontal course positioned above the first horizontal course;

said upper marginal edge region including a plurality of interlock flanges and frangible locating means; and, said lower marginal edge region including an interlock lip for positively engaging said interlock flanges of an underlying panel to positively interlock said at least one panel in said first course with said at least one panel in said second course; said interlock lip being engageable with said frangible locating means to positively locate said interlock lip at a point of intermediate engagement with said interlock flanges during installation to permit relative vertical movement between said overlying upper and lower marginal edge regions due to thermal expansion and contraction of said panels; and said frangible locating means being breakable by said interlock lip upon relative movement caused by contraction of said panels.

2. A wall covering as defined in claim 1 wherein the interlock flanges comprise a base portion extending outwardly from the upper marginal edge region and a relatively flat locking portion disposed substantially parallel to the surface of the upper marginal edge region.

3. A wall covering as defined in claim 1 wherein said frangible locating means comprises a plurality of laterally spaced locating lugs disposed between adjacent ones of said interlock flanges, said locating lugs being frangible to permit movement of said locating lip relative to said interlock flange during thermal contraction.

4. A wall covering as defined in claim 1 wherein the interlock flanges include reinforcement ribs adjacent to their base portions.

5. A wall covering as defined in claim 1 wherein each panel includes side interlock means for interlocking adjacent panels within a course.

6. A wall covering as defined in claim 5 wherein the side interlock means comprise a first projecting flange on a first side marginal edge region and an aperture defined in a second side marginal edge region opposite said first side marginal edge region, said aperture of a first panel being dimensioned to receive at least a portion of the first projecting flange of an adjacent panel.

7. A wall covering as defined in claim 6 wherein said aperture is positioned a distance inboard from a periphery of said second side marginal edge region to provide resistance to panel buckling during use and installation.

8. A wall covering as defined in claim 6 wherein the first projecting flange defines a slot for receiving a portion of said second side marginal edge of said first panel, said slot being open-ended to permit relative movement between said first and said adjacent panels during thermal expansion and contraction.

9. A wall covering as defined in claim 6 wherein said side interlock means further comprises a second projecting flange disposed on said first side marginal edge region, said second projecting flange defining an open-ended slot for receiving a portion of said second side marginal edge region of said adjacent panel.

10. A panel for building a decorative wall covering from a plurality of said panels mounted on a support surface in overlapping relation to form a plurality of substantially horizontal courses, said panel comprising:

a body portion formed with simulated building elements;

a first marginal edge region disposed above said body portion and including a plurality of interlock flanges, said first marginal edge region further including frangible locating means for locating vertically adjacent panels in said wall covering in precise relation;

a second marginal edge region disposed beneath the body portion and including an interlock lip dimensioned for positively engaging said interlock flanges;

a third marginal edge region disposed at a first side of said body portion, said third marginal edge region defining an aperture; and, a fourth marginal edge region disposed at a second side of said body portion opposite said first side, said fourth marginal edge region including a first projecting flange dimensioned to slidably engage said aperture.

11. A panel as defined in claim 10 wherein said interlock flanges comprise a base portion extending outwardly from the first marginal edge region and a relatively flat locking portion disposed relatively parallel to the surface of said first marginal edge region.

12. A panel as defined in claim 11 wherein the frangible locating means is positioned to positively locate the interlock lip of a first panel in said wall covering a distance from the base portion of the interlock flanges of a second panel in said wall covering to thereby accommodate for thermal expansion and contraction.

13. A panel as defined in claim 12 wherein said frangible locating means comprises a plurality of laterally spaced locating lugs disposed between adjacent ones of said interlock flanges, said locating lugs being frangible to permit movement of said locating lip of said first panel relative to said interlock flanges of said second panel during thermal contraction.

14. A panel as defined in claim 11 wherein the interlock flanges include reinforcement ribs adjacent to their base portions.

15. A panel as defined in claim 10 wherein said first projecting flange defines a slot for receiving a portion of said third side marginal edge region of said adjacent panel, said slot being open-ended to permit relative movement between said first and said adjacent panels during thermal expansion and contraction, and wherein said aperture is positioned a distance inboard from a periphery of said panel to resist panel buckling during use and installation.

16. A panel as defined in claim 10 further comprising a second projecting flange disposed on said fourth side marginal edge region, said second projecting flange defining a slot for receiving a portion of said third side marginal edge region of said adjacent panel.

17. A wall covering for mounting on a support surface, said wall covering comprising:

a plurality of panels each having a body portion formed with simulated building elements; said panels each having first and second side marginal edge regions;

said panels being mountable on said support surface in a plurality of horizontal courses with at least one of said panels in a first horizontal course having a first side marginal edge region underlying a second side marginal edge region of an adjacent panel in said first horizontal course;

said first marginal edge region defining an aperture; and, said second marginal edge region including a first projecting flange dimensioned to slidably engage said aperture in said first side marginal edge region of said adjacent panel to interlock said at least one panel and said adjacent panel to permit relative horizontal movement between said overlapping first and second marginal edge regions due to thermal expansion and contraction of said panels.

18. A wall covering as defined in claim 17 wherein said aperture is positioned a distance inboard from a periphery of said first marginal edge region to provide resistance to panel buckling during use and installation.

19. A wall covering as defined in claim 17 wherein the first projecting flange defines a slot for receiving a portion of said first side marginal edge region of said first panel, said slot being open-ended to permit relative movement between said first and said adjacent panels during thermal expansion and contraction.

20. A wall covering as defined in claim 17 further comprising a second projecting flange disposed on said second side marginal edge region, said second projecting flange defining an open-ended slot for receiving a portion of said first side marginal edge region of said first panel.

* * * * *